US006883519B2

(12) United States Patent
Schmidtke et al.

(10) Patent No.: US 6,883,519 B2
(45) Date of Patent: Apr. 26, 2005

(54) STRAP FOR A FULL RESPIRATOR MASK

(75) Inventors: Klaus Schmidtke, Berlin (DE); John F. Kuhn, Wexford, PA (US); Wilfried Hoffmann, Berlin (DE)

(73) Assignee: MSA AUER GmbH, Berlin (DE)

( * ) Notice: Subject to any disclaimer, the term of this patent is extended or adjusted under 35 U.S.C. 154(b) by 0 days.

(21) Appl. No.: 10/257,810

(22) PCT Filed: Oct. 10, 2001

(86) PCT No.: PCT/DE01/03903

§ 371 (c)(1),
(2), (4) Date: Jan. 3, 2003

(87) PCT Pub. No.: WO02/47763

PCT Pub. Date: Jun. 20, 2002

(65) Prior Publication Data

US 2003/0140402 A1 Jul. 31, 2003

(30) Foreign Application Priority Data

Dec. 15, 2000 (DE) ..... 100 64 471

(51) Int. Cl.[7] ..... A62B 18/08
(52) U.S. Cl. ..... 128/207.11; 2/9; 2/452
(58) Field of Search ..... 2/9, 452, 173; 128/207.11, 201.23, 206.12, 206.24, 206.27, 206.23

(56) References Cited

U.S. PATENT DOCUMENTS

| | | | | | |
|---|---|---|---|---|---|
| 2,039,234 A | * | 4/1936 | Malcolm | ..... | 128/206.23 |
| 5,191,882 A | * | 3/1993 | Vogliano | ..... | 128/207.11 |
| 5,481,763 A | | 1/1996 | Brostrom et al. | | |

FOREIGN PATENT DOCUMENTS

| | | |
|---|---|---|
| DE | 3122034 A1 | 12/1982 |
| DE | 29719440 U1 | 2/1998 |
| JP | 2000102624 A | 4/2000 |
| WO | WO 9625983 A | 8/1996 |

* cited by examiner

*Primary Examiner*—Rodney M. Lindsey
(74) *Attorney, Agent, or Firm*—Welsh & Katz, Ltd.

(57) ABSTRACT

A strap for respirator masks comprises a head strap piece, made from elastically flexible synthetic material, with a strap fixing piece and a head plate with a greater wall thickness than the attached head straps. A neck strap, connected to the mask at two fixing points and an extending temple strap, which may be introduced in a detachable and length adjustable manner into fixing clips attached to the head straps, are fixing to the strap fixing piece. The head strap piece thus consists of a straight and a curved piece. The crown-shaped embodiment with the elastic temple band is associated with good fitting and wearing properties and low maintenance requirements.

12 Claims, 3 Drawing Sheets

STRAP FOR A FULL RESPIRATOR MASK

This invention relates to a strap for respirator masks consisting of a head strap piece with two head straps connected to the mask at two fixing points and a joint strap fixing piece for length adjustable neck straps held at two other mask fixing points.

Such a strap made of a flexible but longitudinally non-stretching plastic material comprising a four-point fastening to the mask at the strap ends is known, for example, from JP 2000-102624. This strap arrangement with only four fixing points can easily be mounted to the mask, which also makes it easy to clean. However this design has a disadvantage as it does not ensure a firm fit of the mask, especially when its wearer is put under high strain that causes increased sweat production or when additional forces act on the mask from additional equipment mounted to it such as a welder's attachment or the like. While JP 2000-102624 does propose side straps integrally molded to the fastening plate, which means consisting of the same material as the fixing plate, in conjunction with a five- or six-point fastening, this complex strap design with regard to strap adjustment and fastening is not adequate to ensure safe positioning of the respirator mask on a wearer's head. A five- or six-point strap arrangement would also require a greater mounting and adjusting effort and make cleaning the mask more difficult. Another disadvantage of the strap known from JP 2000-102624 is instability of the flexible strap, which makes putting the mask on difficult and time-consuming for wearers who are out of practice.

It is therefore the problem of this invention to provide a strap for respirator masks that is easy to handle and take care of and that ensures a safe fit when the wearer is exposed to physical strain or when the weight of the mask is increased.

This problem is solved according to the invention by a strap attached at four fixing points comprising the characteristics described in claim 1.

In other words, the concept of the invention is that the head strap piece made of a synthetic material comprises a flexurally stiff head plate between the strap fixing piece and the head straps, compared to which the head straps are considerably more flexible. In this way, the head strap piece is curved in the head strap sections and straight in the head plate section so that it can be put on fast and easily; together with the strap fixing piece and an extending temple strap attached to the fixing clips of the head straps it takes the shape of a hat with curved head straps and a straight head plate so that it can be opened like a cap and placed on the head without prior arranging and aligning the strap and without any risk that the strap might get twisted.

The head strap piece is made of an easy-slide synthetic material and causes minimal friction when slid over head hair. However, the mask is safely and tightly kept on the wearer's head even when the wearer is exposed to strain and produces the respective amounts of sweat.

The subordinate claims disclose further characteristics and advantageous improvements of the invention.

Another advantage of attaching the temple strap to fixing clips that are directly connected with the head straps is that this six-strap arrangement only requires a four-point fastening to the mask, that is, two fixing points for the head strap piece and the temple strap and two fixing points for the neck strap. This makes assembly and disassembly for cleaning the respirator mask easier.

In an embodiment of the invention, the temple strap and the neck strap are conducted in guiding slots of the strap fixing piece so that the smooth and non-elastic neck strap covers the poorly sliding temple strap section facing the wearer's head in the strap fixing piece, thus making the strap slide easily over the head hair without tearing on it or pinching it when the mask is put on. Holding the neck and temple straps in guiding slots of the strap fixing piece is also advantageous and economical from a production engineering point of view.

An advantageous improvement of the invention is to provide lateral guiding grooves on the fixing clips to attach the temple strap that is length-adjustable to the size of the wearer's head and held in a buckle with a centerpiece to the fixing clips.

According to another characteristic of the invention, a gripping clip is molded to the strap fixing piece that makes it even easier to put on the respirator mask because the "crown-shaped" opening of the strap is wide and folded outward at an angle, and because the wearer can use the gripping element when putting on the mask.

An embodiment of the invention is explained in greater detail below with reference to the figures. Wherein.

Figure 1:
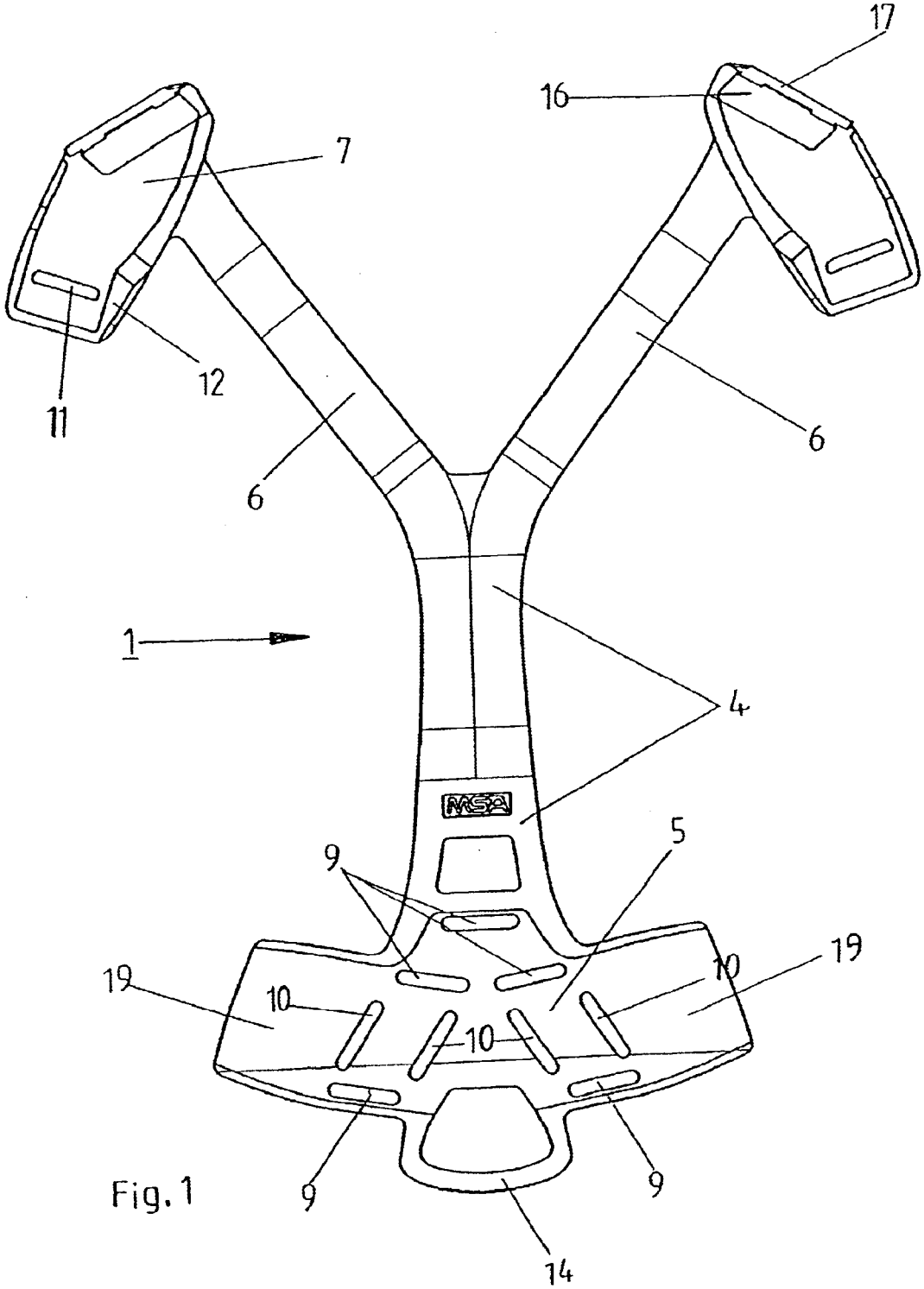
FIG. 1 is a representation of the head strap piece of the strap not showing the temple and neck straps.
Figure 2:
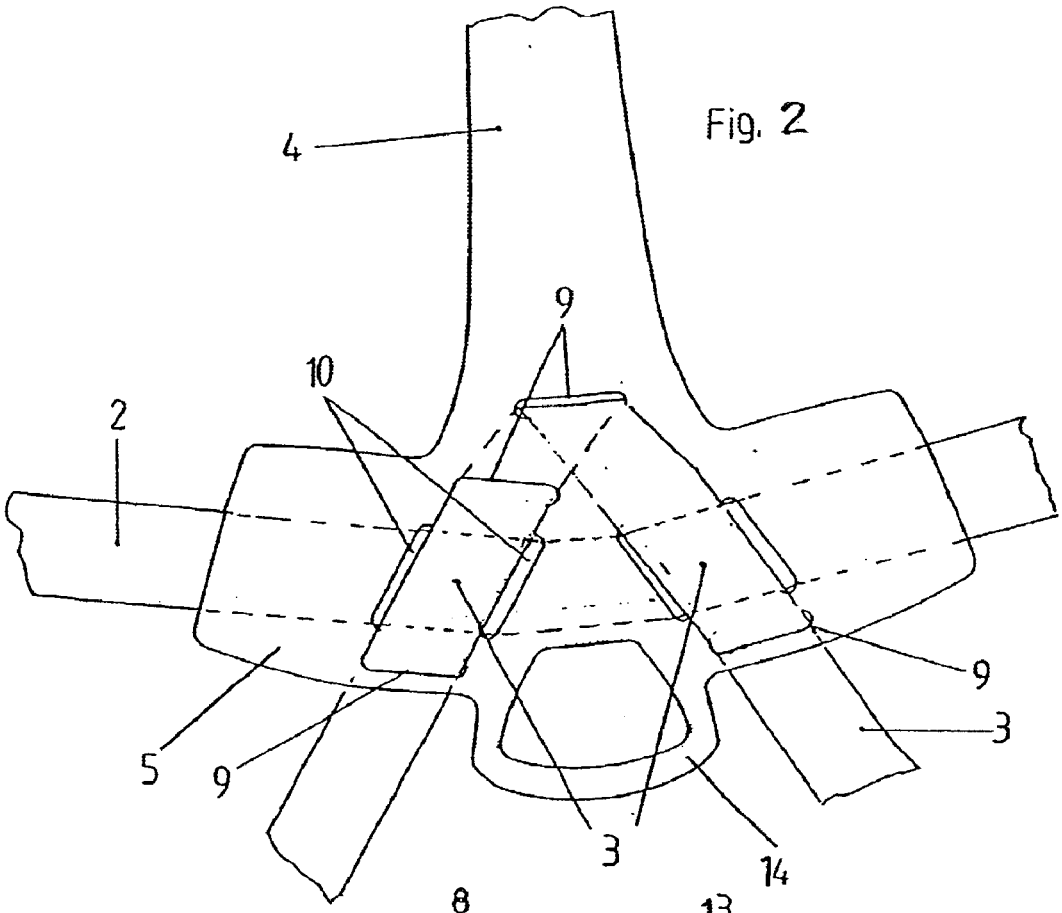
FIG. 2 is a view of the inside of the strap fixing piece of the head plate of the head strap piece that sits tight to the head and is made of a synthetic material.
Figure 3:
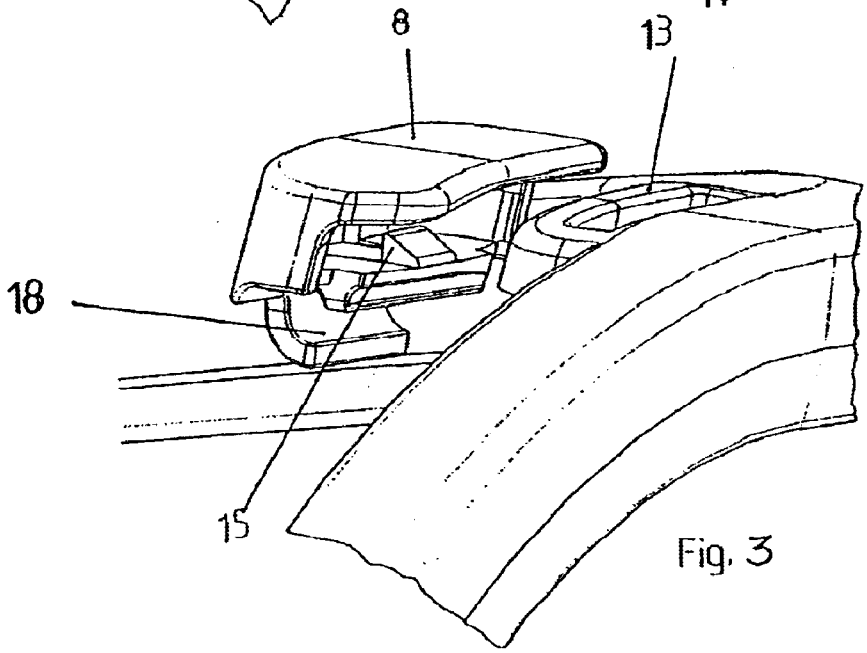
FIG. 3 is a perspective view of the fixing clip for fast attachment of the head strap piece to the respirator mask.
Figure 4:
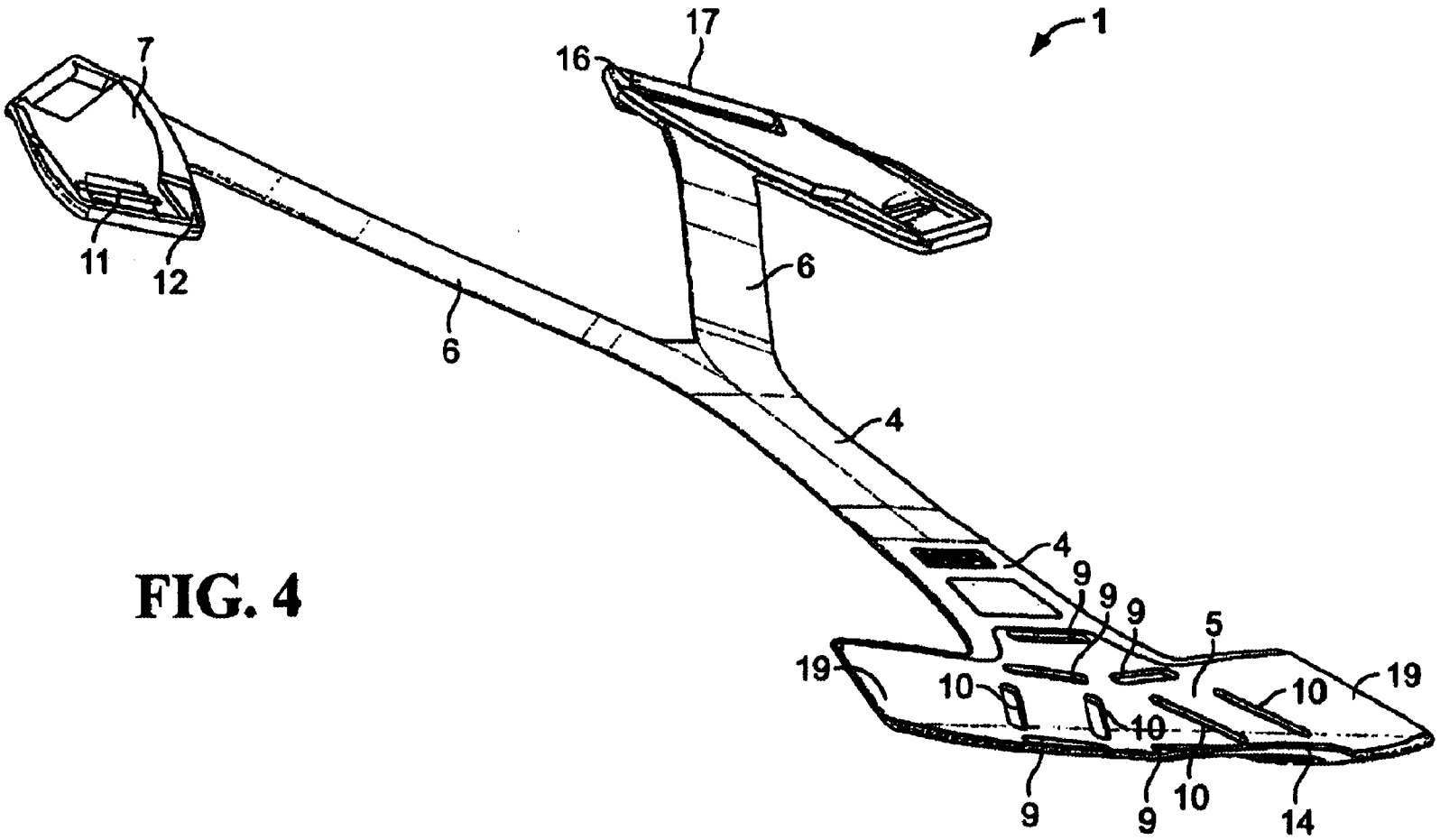
FIG. 4 is a perspective view of FIG. 1.

The strap includes a one-piece head strap piece 1 made by injection molding from a synthetic material to which an elastic temple strap 2 and a non-stretching neck strap 3 are attached, the free ends of which can be adjusted in length and are fastened to the mask using two fixing points. The head strap piece 1 consists of a head plate 4 with a strap fixing piece 5 for the temple strap 2 and the neck strap 3 and head band 6 extending from the head plate 4 and split in a V shape, with fixing clips 7 molded to its two ends in which the ends of the length-adjustable, extending neck strap are held. The free ends of the V-shaped head strap 6 are detachably connected to a fastening clip 8 (see FIG. 3) that is attached to the mask.

The head strap piece 1 is thicker in the section of the head plate 4 (1 mm) than in the section of the head strap 6 (0.5 mm) and is generally stiff, but when put under strain still sufficiently flexible or elastic to adjust to the shape of the wearer's head. The thinner head straps 6 however are less stiff or flexible to the extent that they form an arch that approximately corresponds to the shape of the head. The wall thickness of the head strap 6 may be slightly greater towards the heat-exposed side rims or generally at their ends to ensure a long service life under heat exposure. A head strap piece 1 designed like that, together with the temple strap 2 attached to the strap fixing part 5 and the fixing clips 7 has a crown-shaped structure and can be put on by any user without requiring extra practice or skills thanks to the easy-sliding and smooth plastic surfaces of the head strap piece 1. No part of the strap can twist or tear on a wearer's hair due to friction.

The strap fixing piece 5 comprises guiding slots 9 that in general extend horizontally and parallel to each other and are aligned in such a way that the neck strap 3 they guide forms a V with the fixing points on the mask (not shown). Two second guiding slots 10 that are in true alignment with the ends of the parallel guiding slots 9 are designed for receiving the elastic temple strap 2. The neck strap 3 that extends downwards in a V shape and the generally horizontal temple strap 2 are conducted by the guiding slots 9 or 10, respectively, so that the sections of the elastic temple strap 2 on the inside of the strap fixing piece 5 that face the wearer's head are covered by the smooth, non-elastic neck strap 3. This means that the dull and horizontal sections of the temple strap 2 are covered by the vertical slidable sections of the neck strap 3 so that the strap attachment does not create any resistance when a wearer puts on the respirator mask.

The ends of the temple strap 2 are attached using a buckle (not shown) that is detachably held in two lateral guiding slots 12 of the respective fixing grip in front of a transverse slot 11, and a loop (not shown) of the temple strap 2 conducted through the transverse slot 11 and around the center piece of said buckle. The fixing clips 7 are molded to the head strap 6 to extend approximately in parallel to the mask wearer's temples and support the desired crown shape of the strap.

The head strap 1 is attached to the mask by means of a fixing web 17 pivoted in a recess 16 of the fixing clip 7 and engaging with a fastening clasp 18 of a fastening clip 8 that is connected to the mask; said fastening clasp 18 is detachably interlocked using two oppositely spring-mounted locking clasps 15 into a disk frame eyelet 13. A four-point strap with two-point fastening based on two fixing points (fastening clasps 18) on the mask that ensures a firm fit of the mask and easy maintenance and assembly is thus created using the fixing clips 7 molded to the ends of the V-shaped head strap 6. The extending temple strap 2 that runs at the level of the wearer's temple contributes considerably to a safe and always gastight fit of the respirator mask, even when the wearer is exposed to physical strain or the weight of the mask is increased. The good wearing properties and easy fit of the mask are due to a major extent to the flexurally stiff, easy-sliding design of the head strap piece 1 that consists of a synthetic material and whose head straps and head plate that form the crown differ in stiffness. The figure further shows that a gripping clip 14 is molded to the lower rim of the strap fixing piece 5. The use of this gripping clip makes it even easier to put on the respirator mask fast because the aperture angle of the strap fixing piece 5 and thus of the elastic temple strap 2 is enlarged so that the temple strap cannot twist or pinch the wearer's hair and no interfering frictional forces act upon that hair.

The figures further show that the strap fixing piece 5 is extended at both ends by side clips 19. These counteract any lateral torsion of the temple strap 2 when the mask is put on. In addition, this reduces frictional forces caused by the temple strap and shapes the strap (the temple strap) corresponding to the shape of the head (head circumference) when the mask is put on.

| List of reference symbols | |
|---|---|
| 1 | head strap piece |
| 2 | temple strap |
| 3 | neck strap |
| 4 | head plate |
| 5 | strap fixing piece |
| 6 | head strap |
| 7 | fixing clips |
| 8 | fastening clip |
| 9 | first guiding slots |
| 10 | second guiding slots |
| 11 | transverse slot in 7 |
| 12 | guiding groove in 7 |
| 13 | disk frame eyelets |
| 14 | gripping clip |

-continued

| List of reference symbols | |
|---|---|
| 15 | locking clasp |
| 16 | recess in 7 |
| 17 | fixing web |
| 18 | fastening clasp of 8 |
| 19 | side clips |

We claim:

1. A strap for full respirator masks, consisting of a head strap piece with two head straps attached to the mask at two fixing points and a common strap fixing piece for length-adjustable neck straps held at two other mask fixing points, characterized in that the strap fixing piece merges into a flexurally stiff head plate towards the head straps that is stiffer than the head straps, and in that an extending temple strap is attached to said strap fixing piece.

2. The strap according to claim 1, characterized in that the free ends of the temple strap are attached in a detachable and length-adjustable manner to a fixing clip connected to each head strap to form a four-point fastening.

3. The strap according to claim 1, characterized in that the head strap piece is molded in one piece from a synthetic material with an easily sliding surface and a greater material thickness than the head straps in the sections of the strap fixing piece, the head plate and the head strap ends with fixing clips.

4. The strap according to claim 1, characterized in that the wall thickness of the head straps is about half the wall thickness of the head plate and the strap fixing piece.

5. The strap according to claim 1, characterized in that the cross section of the head straps increases from the outer towards the inner rim for increased thermal resistance.

6. The strap according to claim 2, characterized in that the fixing clips comprise lateral guiding grooves at a transverse slot that detachably hold a fastening buckle with a center piece for fastening the temple strap and adjusting its length.

7. The strap according to claim 2, characterized in that a recess closed by a pivoted fixing web is provided in the fixing clip for detachably locking the head and temple straps to the mask at two fixing points formed by fastening clasps.

8. The strap according to claim 1, characterized in that the head strap piece is injection-molded in one piece from a synthetic material.

9. The strap according to claim 1, characterized in that first guiding slots for angular downward fastening of the neck strap and second guiding slots for the generally horizontal fastening of the temple strap are provided in the strap fixing piece, wherein the first and second guiding slots are aligned to each other, and straps are conducted, in such a way that the smooth and non-extending neck strap covers the dull, extending portion of the temple strap on the inner surface of the head strap piece that is facing the wearer's head.

10. The strap according to claim 1, characterized in that a gripping clip is molded to the lower rim of the strap fixing piece.

11. The strap according to claim 7, characterized in that the fastening clasp for locking the fixing clip is provided at a fastening clip with opposing spring-mounted locking clasps, and that said fastening clip can be locked into a disk frame eyelet attached to the mask.

12. The strap according to claim 1, characterized in that the strap fixing piece is extended by side clips on both ends.

* * * * *